US006288526B1

(12) United States Patent
Olah

(10) Patent No.: US 6,288,526 B1
(45) Date of Patent: Sep. 11, 2001

(54) VOLTAGE DOWN CONVERTER FOR MULTIPLE VOLTAGE LEVELS

(75) Inventor: Robert A. Olah, Sunnyvale, CA (US)

(73) Assignee: Xilinx, Inc., San Jose, CA (US)

( * ) Notice: Subject to any disclaimer, the term of this patent is extended or adjusted under 35 U.S.C. 154(b) by 0 days.

(21) Appl. No.: 09/583,323

(22) Filed: May 30, 2000

Related U.S. Application Data

(62) Division of application No. 09/135,610, filed on Aug. 18, 1998, now Pat. No. 6,114,843.

(51) Int. Cl.[7] ..... G05F 3/22

(52) U.S. Cl. ..... 323/316; 323/280; 323/281; 323/314

(58) Field of Search ..... 323/273, 280, 323/281, 313, 314, 315, 316

(56) References Cited

U.S. PATENT DOCUMENTS

| | | | | |
|---|---|---|---|---|
| 4,665,356 | | 5/1987 | Pease | 323/314 |
| 5,281,906 | | 1/1994 | Thelen, Jr. | 323/313 |
| 5,514,948 | | 5/1996 | Okazaki | 323/314 |
| 5,532,618 | | 7/1996 | Hardee et al. | 326/63 |
| 6,114,843 | * | 9/2000 | Olah | 323/280 |

OTHER PUBLICATIONS

Koichiro Ishibashi; Katsuro Sasaki; and Hiroshi Toyoshima, "A Voltage down Converter with Submicroampere Standby Current for Low–Power Static RAM's", IEEE Journal of Solid–State Circuits, vol. 27, No. 6, Jun. 1992, pp. 920–926.

Rakesh Patel; Wilson Wong; John Lam; Tin Lai; Tom White; and Sammy Cheung, "A 3.3–V Programmable Logic Device that Addresses Low Power Supply and Interface Trends", IEEE 1997 Custom Integrated Circuits Conference, 1997, pp. 539–542. (no month).

"The Programmable Logic Data Book 1998", available from Xilinx, Inc., 2100 Logic Drive, San Jose, CA 95124, pp. 3–5 through 3–15. (no month).

* cited by examiner

*Primary Examiner*—Jessica Han
(74) *Attorney, Agent, or Firm*—Patrick T. Bever, Esq.; Edel M. Young

(57) ABSTRACT

A voltage regulator circuit in an integrated circuit (IC) device such as a Complex Programmable Logic Device (CPLD) comprises a reference voltage generator, a tuning circuit, and an output driver circuit. The reference voltage generator converts an external supply voltage provided to the IC device into a stable reference voltage. The tuning circuit converts the stable reference voltage into a desired internal supply voltage, such as the reduced voltage required by deep sub-micron transistors. The output driver circuit provides the desired internal supply voltage with sufficient current to properly power the circuits of the IC device. The tuning circuit includes an op-amp and resistive elements configured in a voltage divider configuration in the negative feedback loop of the op-amp. The output of the op-amp can be set to the desired internal supply voltage by properly sizing the resistive elements. By making at least one of the resistive elements adjustable, a variable internal supply voltage can be provided by the voltage regulator circuit.

3 Claims, 4 Drawing Sheets

VOLTAGE DOWN CONVERTER FOR MULTIPLE VOLTAGE LEVELS

RELATED APPLICATION

This application is a divisional application of U.S. patent application Ser. No. 09/135,610 entitled "Voltage Down Converter for Multiple Voltage Level" by Robert A. Olah which was filed on Aug. 18, 1998 now U.S. Pat. No. 6,114,843.

FIELD OF THE INVENTION

The present invention relates to voltage conversion circuits, and more particularly, to a voltage regulator circuit in an integrated circuit device.

BACKGROUND OF THE INVENTION

Integrated circuit (IC) devices typically include numerous transistors that are fabricated on, for example, silicon wafers. To increase production yields and lower total IC device costs, semiconductor manufacturers are continually striving to reduce the size of the transistors in IC devices. However, for a given power supply voltage, the electric field strength, e.g., the change in voltage per unit length, that these transistors are exposed to increases as the size of the transistors is reduced. As IC device geometries shrink to the deep sub-micron level (i.e. less than 0.5 um), the electric fields generated by the 5V supply voltages historically used to power IC devices can degrade or even destroy the transistors in those IC devices. For example, the performance of a sub-micron MOS transistor having an effective channel length of 0.35 um is impaired under a 5V supply voltage due to injection of hot electrons into the gate of the MOS transistor. In addition, the electric field generated by a 5V supply voltage across a sub-micron MOS transistor can also cause total failure due to gate oxide breakdown. Therefore, a reduced power supply voltage must be available to reap the cost and efficiency benefits of deep sub-micron transistors while maintaining overall IC performance and reliability. The recent trend towards the use of 3.3V supply voltages is indicative of this need, and further reductions in supply voltages will become necessary as IC device geometries continue to shrink.

At the same time, a 3.3V external supply voltage will not necessarily be available to power deep sub-micron IC devices. While memory and microprocessor boards can often be custom designed to provide 3.3V to those IC devices, other types of IC devices may not have that option available. For example, Programmable Logic Devices (PLD's) are a type of IC device comprising user-configurable logic elements and interconnect resources that are programmable to implement user-defined logic operations (that is, a user's circuit design). PLD's have begun to incorporate 0.35 um transistors that require the 3.3V power supply voltage. However, because of their configurable purpose, PLD's will often be used in systems that operate under 5V power supply voltages due to other IC devices in the system that require 5V, such as TTL or ECL devices. Therefore, many IC devices include a voltage down converter (VDC) to reduce an external power supply voltage to the level required by the transistors in those IC devices.

FIG. 1*a* shows a conventional VDC 100 used in the EPF10K50V PLD from ALTERA Corporation in San Jose, Calif. VDC 100 comprises NMOS transistors 101, 102, and 103, and an adjustment circuit 105. NMOS transistor 103 is coupled between an external power supply voltage terminal and an output terminal 104. Adjustment circuit 105 is coupled between output terminal 104 and the gate terminal of NMOS transistor 103. NMOS transistors 101 and 102 are both drain-gate coupled and are serially connected between the external power supply voltage terminal and the gate terminal of NMOS transistor 103. As a result, an external supply voltage Vccext at the external power supply voltage terminal is reduced by the threshold voltage drops across NMOS transistors 101 and 102, thereby applying a voltage Vg to the gate terminal of transistor 103. Voltage Vg is given by the equation:

$$Vg=Vccext-Vtn(\mathbf{101})-Vtn(\mathbf{102}) \quad [1]$$

where Vtn(101) and Vtn(102) are the threshold voltage drops across NMOS transistors 101 and 102, respectively. Voltage Vg brings NMOS transistor 103 into conduction, thereby providing a reference voltage Vccint at output terminal 104. Reference voltage Vccint is given by the equation:

$$Vccint=Vg-Vtn(\mathbf{103}) \quad [2]$$

where Vtn(103) is the threshold voltage drop across NMOS transistor 103. Therefore, reference voltage Vccint is effectively "programmed" by NMOS transistors 101, 102, and 103. If the three NMOS transistors are matched, combining equations [1] and [2] yields:

$$Vccint=Vccext-3Vtn \quad [3]$$

where Vtn is the threshold voltage drop across each of NMOS transistors 101, 102, and 103. Because voltage vg is less than external supply voltage Vccext, NMOS transistor 103 cannot provide a voltage Vccint greater than voltage Vg at output terminal 104. Therefore, NMOS transistors 101 and 102 effectively "program" reference voltage Vccint. For example, a typical value for the threshold voltage drop of an NMOS transistor is 0.5V. In that case, the reference voltage Vccint provided by VDC 100 for an external supply voltage Vccext of 5.0V would be 3.5V (i.e., 5.0V−3*(0.5V)=3.5 V), which would be suitable for driving 3.3V IC devices. Adjustment circuit 105 helps to maintain output stability under load variations. If the load current required from output terminal 104 increases, adjustment circuit 105 forces voltage Vg higher to drive more current through NMOS transistor 103. On the other hand, if voltage Vccint rises excessively, adjustment circuit 105 decreases voltage Vg to compensate. However, although VDC 100 is a simple circuit for providing a reduced reference voltage, it is unacceptable for situations requiring a precise, stable reference voltage. First, any variations in the value of external supply voltage Vccext directly affect the value of reference voltage Vccint. In addition, the threshold voltage drop Vtn across transistors 101 and 102 varies with process, making a specific reference voltage Vccint difficult to achieve. Finally, the threshold voltage drop Vtn also varies with temperature, leading to fluctuations in reference voltage Vccint during normal operation of VDC 100.

FIG. 1*b* shows a VDC 110, as described by Ishibashi et al. in "A Voltage Down Converter with Submicroampere Standby Current for Low-Power Static RAM's" (*IEEE Journal of Solid-State Circuits*, Vol. 27, No. 6, June 1992.). VDC 110 provides a stable reference voltage of 4.5V to optimize power dissipation, reliability, and operation speed in a static random access memory (SRAM). VDC 110 comprises a depletion-mode NMOS transistor 112, matched PMOS transistors 131–133, matched NMOS transistors 141–145, matched NMOS transistors 151–153, and matched depletion-mode NMOS transistors 161–163. Depletion-mode NMOS transistor 112, PMOS transistor 131, and NMOS transistor 141 are serially coupled between an external voltage supply terminal and ground. PMOS transistor 132 and NMOS transistor 142 are serially coupled between the external voltage supply terminal and ground. PMOS transistor 133 and depletion-mode transistors 151–153 are serially coupled between the external voltage supply terminal and ground. Finally, depletion-mode NMOS transistors 161–163 are serially coupled with NMOS transistors 143–145, respectively, between the external voltage supply terminal and ground.

When a voltage Vccext is applied to the external Vcc supply terminal, gate-source coupled depletion-mode NMOS transistor 112 is forced to operate in its linear region and generates a small programming current Iprog. Because depletion-mode NMOS transistor 112 is operating in its linear region, programming current Iprog is relatively independent of supply voltage and temperature variations. Meanwhile, since the gate and drain terminals of PMOS transistor 132 are coupled to the gate terminal of PMOS transistor 131, PMOS transistor 132 is biased into conduction and attempts to mirror the current flowing through PMOS transistor 131. Similarly, because the gate and drain terminals of NMOS transistor 141 are coupled to the gate terminal of NMOS transistor 142, NMOS transistor 141 is biased into conduction and attempts to mirror the current flowing through NMOS transistor 142. As a result, programming current Iprog flows through PMOS transistor 131 and NMOS transistor 141, and a reference current Iref equal to programming current Iprog flows through PMOS transistor 132 and NMOS transistor 142. A gate voltage Vgp at the commonly connected gate terminals of PMOS transistors 131 and 132 is applied to the gate terminal of PMOS transistor 133. Voltage Vgp forces PMOS transistor 133 to conduct a current Ia, which is equal to programming current Iprog. Gate-drain coupled NMOS transistors 151–153 are sized to produce a threshold voltage drop Vtn when current Ia is equal to current Iprog, so the voltage at node A is 3*Vtn. At the same time, a gate voltage Vgn at the commonly connected gate terminals of NMOS transistors 141 and 142 is applied to the gate terminals of NMOS transistors 143–145. Gate voltage Vgn forces NMOS transistors 143, 144, and 145 to conduct currents Ib, Ic, and Id, respectively, where currents Ib–Id are all equal to programming current Iprog. Depletion-mode NMOS transistors 161–163 are sized to conduct a current equal to current Iprog when biased by a gate-drain voltage V'tn. Therefore, the voltage at node B is 3*Vtn−V'tn. Similarly, the voltage at node C is 3Vtn−2V'tn, and the voltage at node D is 3Vtn−3V'tn. Therefore, the output voltage Vccint of VDC 110 is given by the equation:

$$Vccint=3\Delta Vtn \quad [4]$$

where ΔVtn is equal to the threshold voltage difference between enhancement-mode NMOS transistors 151–153 and depletion-mode NMOS transistors 161–163 (i.e., Vtn−V'tn). In this manner, VDC 110 provides a reduced supply voltage. The characteristics of NMOS transistors 151–153 and depletion-mode NMOS transistors 161–163 determine the value of output voltage Vccint. For example, when the $As^+$ channel dopant concentration in depletion-mode NMOS transistors 161–163 is $3\times10^{12}$ $cm^{-2}$, a programming current Iprog of 30 nA produces a threshold voltage difference ΔVtn of 1.45 V. Output voltage Vccint then becomes 4.35 V, the desired SRAM supply voltage. Because of the stability of programming current Iprog provided by depletion-mode NMOS transistor 112, VDC 110 produces a more constant output voltage than does VDC 100 from Altera Corporation. However, because VDC 110 is dependant on transistor threshold voltage drops to set output voltage Vccint, manufacturing process variations can still make specific values of output voltage Vccint difficult to achieve. In addition, output voltages Vccint that are not integral multiples of threshold voltage difference Δ Vtn cannot be achieved.

Accordingly, it is desirable to provide a VDC that provides a stable reference output voltage that is immune to temperature and manufacturing process variations, and can be set to a desired output voltage value.

SUMMARY OF THE INVENTION

The present invention is directed towards a voltage regulator circuit that is connected between the power pins and the internal circuits of an integrated circuit (IC) device, such as a Complex Programmable Logic Device (CPLD). The voltage regulator circuit reduces an external supply voltage applied to the power pins into an internal supply voltage suitable for powering the internal logic circuits or I/O circuits of the IC device, using a reference voltage generator, a tuning circuit, and an output driver circuit. The reference voltage generator converts the external supply voltage into a stable reference voltage, which the tuning circuit uses to generate an output voltage equal to the desired internal supply voltage. The output driver circuit then buffers the output voltage from the tuning circuit in order to provide the internal supply voltage with sufficient output current to properly drive the circuits of the IC device. By utilizing a tuning circuit in conjunction with a reference voltage generator, the present invention overcomes the accuracy, stability, and complexity issues associated with conventional voltage down converters (VDCs).

In accordance with a first embodiment of the present invention, the reference voltage generator comprises a bandgap reference generator, the tuning circuit comprises an op-amp and first and second resistive elements configured as a non-inverting amplifier, and the output driver circuit comprises op-amp controlled power transistors connected between the power pins of the IC device and the output terminal of the output driver circuit. Proper sizing of the first and second resistive elements enables the tuning circuit to convert the reference voltage provided by the bandgap reference generator into the desired internal supply voltage. The tuning circuit eliminates the need to configure the bandgap reference generator to produce the desired internal supply voltage, which is often difficult, if not impossible. In addition, the first and second resistive elements can be sized to produce customized internal supply voltages. The op-amp of the output driver circuit forces the power transistors to provide the necessary current output at the desired internal supply voltage generated by the tuning circuit. The output driver circuit also includes output capacitance to improve transient response.

In accordance with a second embodiment of the present invention, at least one of the resistive elements in the tuning circuit is an adjustable resistor. This adjustment capability allows user-control over the output voltage from the op-amp of the tuning circuit. This advantageously enables, for example, fine adjustment capability to compensate for processing variations or the use of user-selectable internal supply voltage levels. According to a first aspect of the present invention, the adjustable resistor comprises multiple serial resistors. By selectively bypassing a selected number of the serial resistors, the total resistance provided by the serial resistors can be varied. According to a second aspect of the present invention, the adjustable resistor comprises a FET biased into its linear region. By adjusting the gate voltage applied to the FET, the effective resistance provided by the FET can be varied.

The present invention will be more fully understood in view of the following description and drawings.

DETAILED DESCRIPTION OF THE DRAWINGS

The following discussion illustrates an embodiment in which the voltage regulator circuit of the present invention is utilized in a Complex Programmable Logic Device (CPLD). It should be noted, however, that the disclosed voltage regulator circuit may also be implemented in other types of IC devices.

Figure 1A:
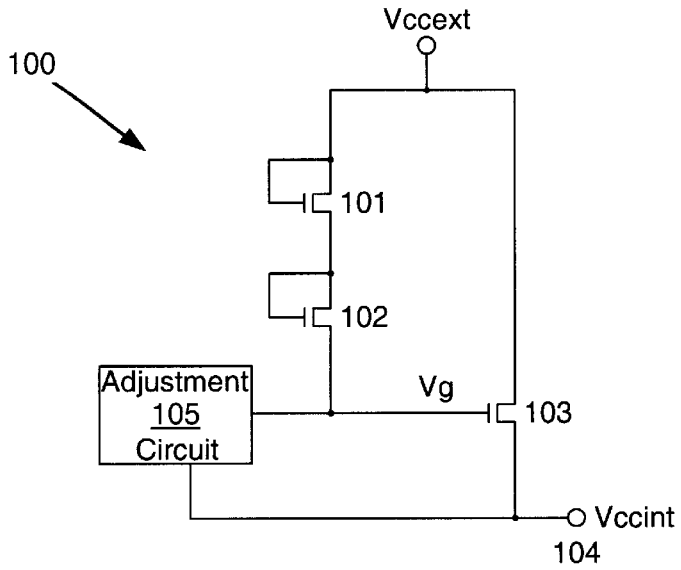
FIG. 1a (PRIOR ART)
FIGS. 1*a* and 1*b* are circuit diagrams of conventional voltage down convelrters.
Figure 1B:
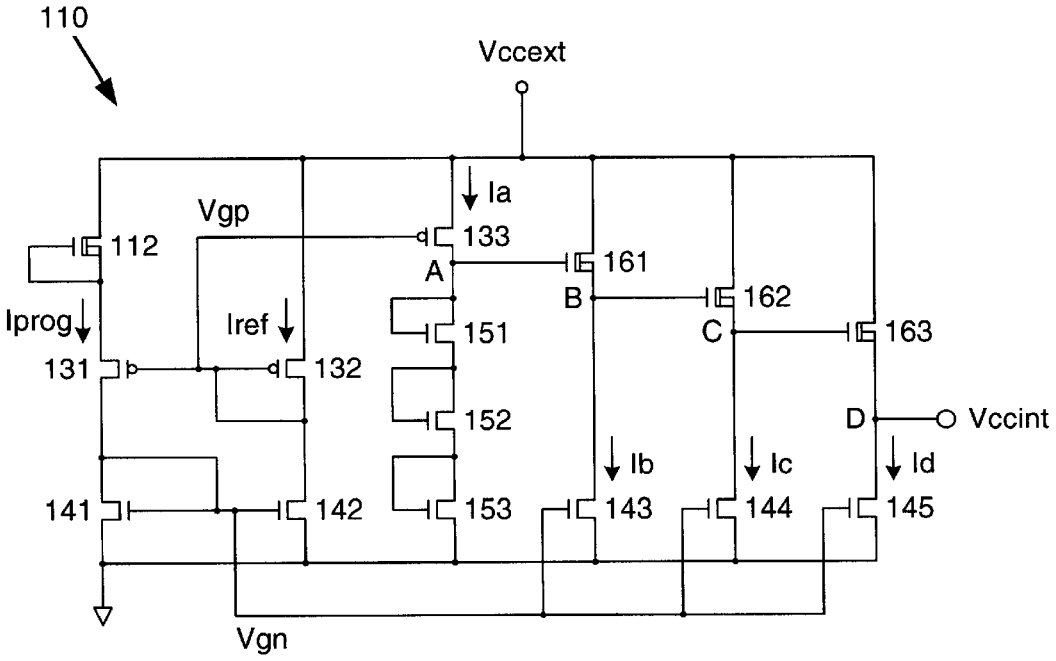
FIG. 1b (PRIOR ART)
Figure 2:
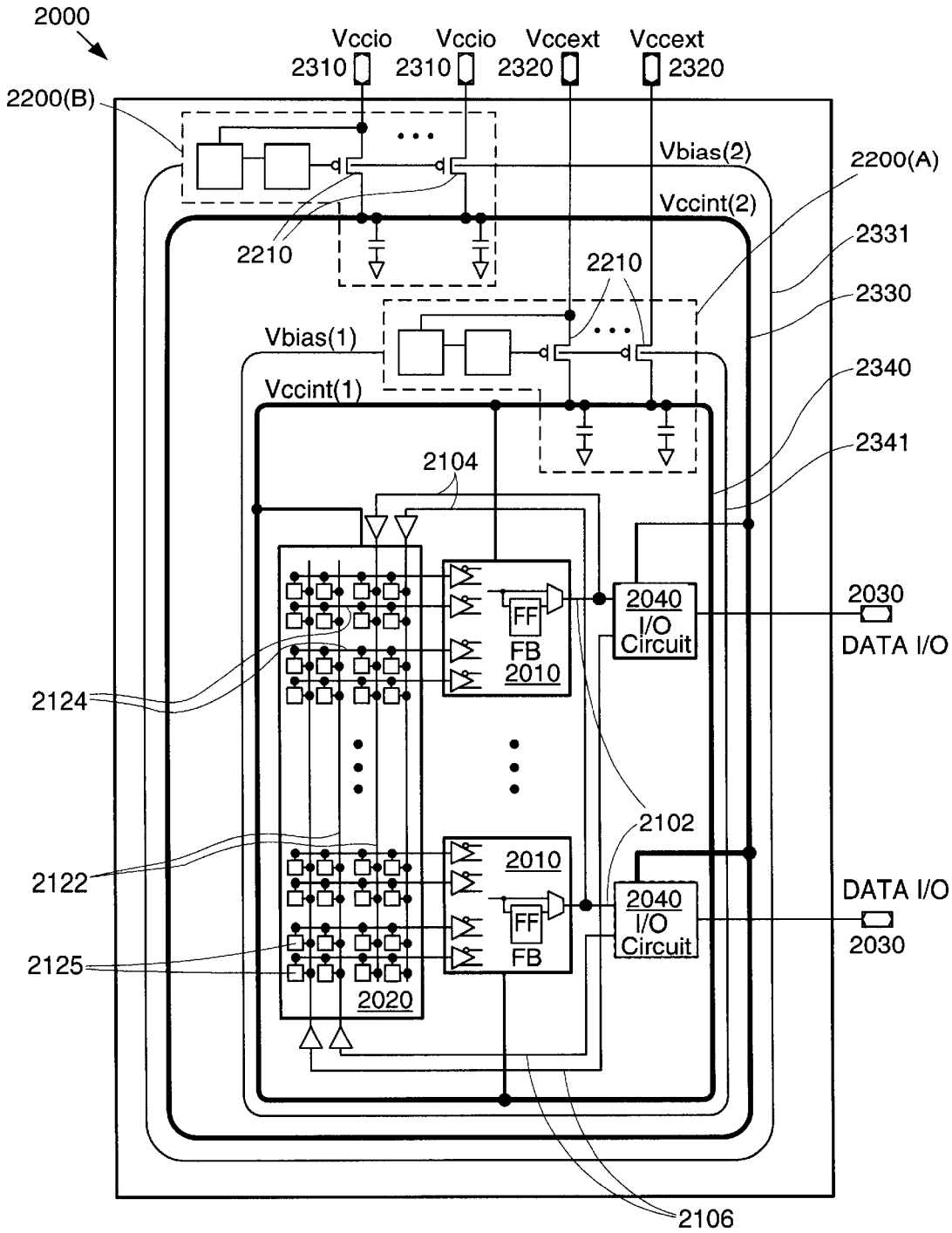
FIG. 2 is a simplified circuit diagram of a Complex Programmable Logic Device including a voltage regulator in accordance with the present invention.

FIG. 2 shows a portion of a CPLD 2000, which represents one of several Programmable Logic Device (PLD) types. CPLD 2000 has internal circuitry that includes configurable function blocks (FBs) 2010 and a programmable interconnect matrix 2020 that transmit signals to or receive signals from data I/O pins 2030 via I/O circuits 2040. Although greatly simplified, the internal circuitry of CPLD 2000 is generally consistent with XC9500™ series CPLD's that are produced by Xilinx, Inc. of San Jose, California. The internal circuitry is briefly described in the following paragraphs. Additional detail regarding the structure and function of these circuits is provided in *The* 1998 *Programmable Logic Data Book*, published by Xilinx, Inc. on pages 3–5 through 3–15 (incorporated herein by reference).

Each FB 2010 of CPLD 2000 includes configurable combinational circuitry that is programmable to generate a desired logic function in response to input signals received from interconnect matrix 2020. Each FB 2010 is configurable to generate combinational output signals (i.e., the output signals are transmitted directly to an output line 2102), or registered output signals (i.e., the output signals are routed through a flip-flop (FF) to output line 2102). Each output signal on output line 2102 either is transmitted to an I/O circuit 2040 or is fed-back to interconnect matrix 2020 on feedback lines 2104. Typically, the combinational circuitry of all FB's 2010 in CPLD 2000 are identical.

Interconnect matrix 2020 is provided to selectively route feedback and input signals to designated FBs 2010 in accordance with a user's logic operation. Interconnect matrix 2020 includes word lines 2122, bit lines 2124, and programmable connection switches 2125. Each word line 2122 receives either a feedback signal from a feedback line 2104 or an input signal from an input line 2106. Each bit line 2124 is programmably coupled to several word lines 2122 via connection switches 2125. Connection switches 2125 typically include nonvolatile memory devices such as EPROM, EEPROM, or flash-EPROM cells. When programmed, each memory device is activated by high (or low) signals on an associated word line to pull-down the voltage on an associated bit line 2124. This allows interconnect matrix 2020 to route feedback signals onto a bit line 2124 that is coupled to a designated FB 2010.

Besides FBs 2010 and interconnect matrix 2020, CPLD 2000 also includes input/output (I/O) circuits 2040 that can be used for either signal input operations or signal output operations. In IC devices that are not programmable, it is common for input signals to enter through I/O circuits that operate only to transmit input signals from input pins to the internal circuitry of the IC device. Such I/O circuits are well known.

In addition to FBs 2010, interconnect matrix 2020, and I/O circuits 2040, CPLD 2000 includes two voltage regulator circuits 2200(A) and 2200(B) that are produced in accordance with the present invention. Although the present invention is described below with reference to CPLD 2000, the present invention may be beneficially utilized in other types of PLDs and ICs. Therefore, the appended claims should not be limited to CPLD applications of the disclosed voltage regulator circuit.

Voltage regulator circuits 2200(A) and 2200(B) are provided to ensure that the voltage requirements of the circuits in CPLD 2000 are met. Power for FBs 2010 and interconnect matrix 2020 is provided through multiple circuit power pins 2320, which receive an external supply voltage Vccext from an external (off-chip) voltage source (not shown). Although depicted at a common location for clarity in FIG. 2, circuit power pins 2320 would typically be distributed around CPLD 2000. Multiple PMOS power transistors 2210 included in voltage regulator circuit 2200(A) couple circuit power pins 2320 to an internal power bus 2340. Voltage regulator circuit 2200(A) further comprises circuits that apply a bias voltage Vbias(1) to an internal logic bus 2341, which is connected to the gate terminals of the multiple PMOS power transistors 2210. Bias voltage Vbias(1) is such that each of the multiple PMOS power transistors 2210 provides a desired internal supply voltage Vccint(1) to internal power bus 2340. The use of multiple circuit power pins 2320 reduces inductance effects within CPLD 2000 and also prevents excessive power draw through any single pin. Internal power bus 2340 then routes this desired internal supply voltage to FB's 2010 and interconnect matrix 2020. Similarly, power for I/O circuits 2040 is provided through multiple I/O power pins 2310, which receive an external power supply voltage Vccio. External power supply voltage Vccio is typically equal to external supply voltage Vccext and is typically received from the same external voltage source. Multiple PMOS power transistors 2210 included in voltage regulator circuit 2200(B) couple I/O power pins 2310 to an I/O power bus 2330. Voltage regulator circuit 2200(B) further comprises circuits that apply a bias voltage Vbias(2) to an I/O logic bus 2331, which is connected to the gate terminals of the multiple PMOS power transistors 2210. Each of the multiple PMOS power transistors 2210 to which bias voltage Vbias(2) is applied provides a desired internal supply voltage Vccint(2) to I/O power bus 2330. I/O power bus 2330 then routes this reduced voltage to I/O circuits 2040. Although I/O power bus 2330 and internal power bus 2340 typically carry the same supply voltage (i.e., Vccint(1) is equal to Vccint(2)), the two buses are usually discrete in order to prevent activity being handled by I/O circuit 2040 from affecting FBs 2010 and interconnect matrices 2020.

Figure 3:
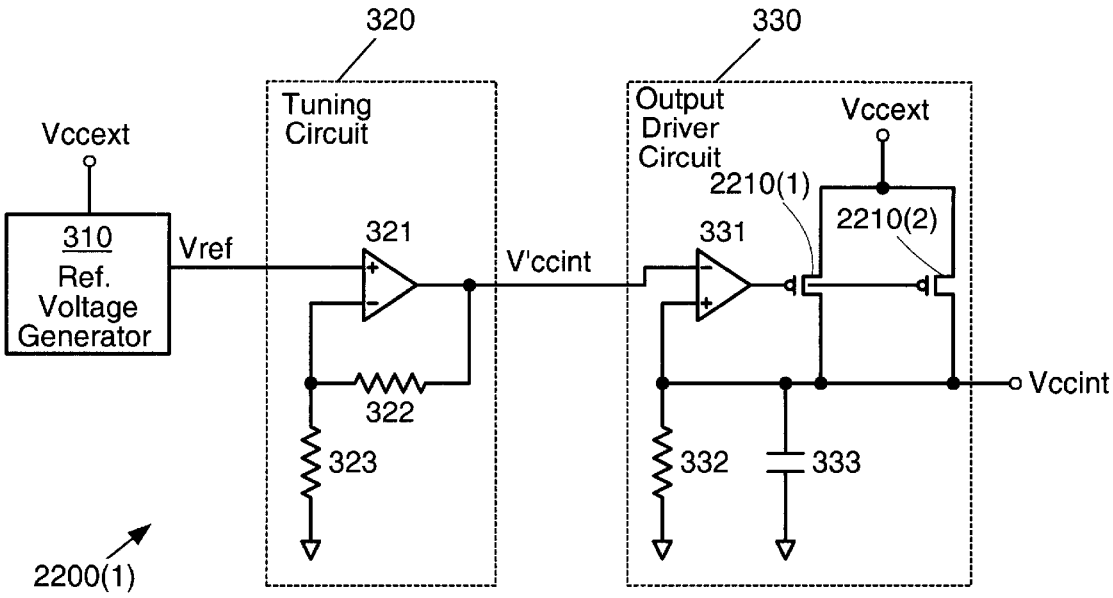
FIG. 3 is a circuit diagram of a first embodiment of a voltage regulator in accordance with the present invention.

FIG. 3 is a schematic diagram showing a voltage regulator circuit 2200(1) (corresponding to both voltage regulator 2200(A) and voltage regulator 2200(B) in FIG. 2) in accordance with a first embodiment of the present invention. Voltage regulator circuit 2200(1) reduces an external supply voltage Vccext to an internal supply voltage Vccint for IC devices requiring a supply voltage smaller than external supply voltage Vccext. Voltage regulator circuit 2200(1) comprises a reference voltage generator 310, a tuning circuit 320, and an output driver circuit 330. Reference voltage generator 310 converts the external supply voltage Vccext to a stable reference voltage Vref. Tuning circuit 320 then uses reference voltage Vref to generate a supply reference voltage V'ccint, which is equal in magnitude to a desired internal supply voltage Vccint. Supply reference voltage V'ccint is buffered by output driver circuit 330 to provide internal supply voltage Vccint with sufficient current sourcing capability.

Figure 4:
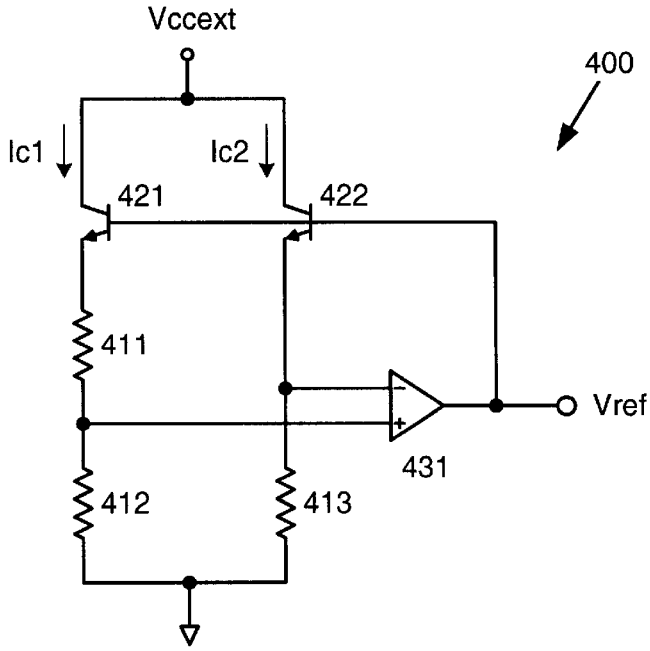
FIG. 4 is a circuit diagram of an embodiment of a bandgap reference generator.

In one embodiment, reference voltage generator 310 includes a bandgap reference generator 400, as shown in FIG. 4. Bandgap reference generator 400 comprises matched npn transistors 421 and 422, resistors 411–413, and an op-amp 431. The collector terminals of npn transistors 421 and 422 are coupled to receive external supply voltage Vccext, and the base terminals of npn transistors 421 and 422 are coupled to the output terminal of op-amp 431. Resistors 411 and 412 are serially coupled between the emitter terminal of npn transistor 421 and ground, while resistor 413 is coupled between the emitter terminal of npn transistor 422 and ground. Finally, the inverting input terminal of op-amp 431 is coupled to the emitter terminal of transistor 422, while the non-inverting input terminal of op-amp 431 is coupled to the junction of resistors 411 and 412.

Bandgap reference generator 400 operates as follows. Op-amp 431 attempts to equalize the voltages at its inverting and non-inverting input terminals. Therefore, the voltage difference between the base-emitter voltage Vbe1 of npn transistor 421 and the base-emitter voltage Vbe2 of npn transistor 422 must equal the voltage drop V411 across resistor 411. The Ebers-Moll equation states that base-emitter voltage Vbe1 is given by:

$$Vbe1=V_{T1}*\ln(Ic1/Is1-1) \quad [5]$$

where $V_{T1}$, IC1, and Is1 are the temperature dependent voltage, collector current, and saturation current, respectively, for npn transistor 421. Temperature dependent voltage$V_{T1}$ is given by:

$$V_{T1}=k*T1/q \quad [6]$$

where k is Boltzmann's constant ($1.38\times10^{-23}$ joules/°K.), T1 is the temperature of npn transistor 421 in degrees Kelvin, and q is the electron charge ($1.60\times10^{-19}$ coulombs). For npn transistor 422, the Ebers-Moll equation states that base-emitter voltage Vbe2 is given by:

$$Vbe2=V_{T2}*\ln(Ic2/Is2-1) \quad [7]$$

where $V_{T2}$, Ic2, and Is2 are the temperature dependent voltage, collector current, and saturation current, respectively, for npn transistor 422. Temperature dependent voltage $V_{T2}$ is given by the equation:

$$V_{T2}=k*T2/q \quad [8]$$

where T2 is the temperature of npn transistor 421 in degrees Kelvin. Npn transistors 421 and 422 are matched transistors manufactured in close proximity with one another. As a result, both transistors will be at approximately the same temperature, so that:

$$V_{T1}=V_{T2}=V_T=kT/q \quad [9]$$

where $V_T$ is the temperature dependent voltage and T is the temperature of both npn transistors 421 and 422. In addition, the collector current for an npn transistor operating in its active region is much greater than its saturation current, so the −1 term in equations [5] and [7] can be neglected. Therefore, the voltage drop V411 across resistor 411 is given by:

$$V411=V_T*\ln[(Ic2/Ic1)(Is1/Is2)] \quad [10]$$

Then, since saturation currents Is1 and Is2 are simply proportional to the emitter areas of npn transistors 421 and 422, respectively, equation [10] can be rewritten as:

$$V411=VT*\ln[(Ic2/Ic1)(A1/A2)] \quad [11]$$

where A1 is the emitter area of npn transistor 421 and A2 is the emitter area of npn transistor 422. In addition, by forcing its inverting and non-inverting input terminals to be equal, op-amp 431 maintains the relationship:

$$Ic1*R412=Ic2*R413 \quad [12]$$

where R412 and R413 are the resistances of resistors 412 and 413, respectively. Substituting equation [12] into equation [11] produces:

$$V411=V_T*\ln[(R412*A1/R413*A2)] \quad [13]$$

Meanwhile, reference voltage Vref can be written as:

$$Vref=Vbe2+Ic2*R413 \quad [14]$$

Substituting equation [12] into equation [14] provides:

$$Vref=Vbe2+Ic1*R412 \quad [15]$$

However, since Icl is equal to V411/R411, where R411 is the resistance of resistor 411, equation [15] can be written as:

$$Vref=Vbe2+V411(R412/R411) \quad [16]$$

Therefore, substituting equation [13] into equation [16] provides:

$$Vref=Vbe2+G*V_T \quad [17]$$

where G is a gain constant equal to (R412/R411)*ln [(R412*A1)/(R413*A2)]. Differentiating equation [17] with respect to temperature produces the relationship:

$$dvref/dT=dvbe2/dT+GdV_T/dT \quad [18]$$

The base-emitter voltage Vbe1 of transistor 422 decreases with increasing temperature. However, as indicated by equation [9], the temperature dependent voltage $V_T$ of transistor 422 increases with increasing temperature. Therefore, by properly sizing gain constant G, decreases in base-emitter voltage Vbe1 can be compensated by increases in temperature dependent voltage $V_T$, producing a reference voltage Vref that does not vary with temperature. For example, if npn transistor 422 has a base-emitter voltage variation rate of −2.5 mV/° C. and a threshold voltage variation rate of 0.085 mV/° C., then equation [15] becomes:

$$0=(-2.5+0.085G)mV/°\ C. \quad [19]$$

Therefore, a gain constant G of approximately 29.4 provides a reference voltage Vref that does not vary with temperature. A gain constant G equal to 29.4 produces a stable, thermallycompensated output reference voltage Vref in the range of 1.2–1.5 V, depending on the specific resistance values selected for resistors 411–413.

Returning to FIG. 3, tuning circuit 320 is coupled to receive reference voltage Vref from reference voltage generator 310. As shown in FIG. 3, in accordance with a first embodiment of the present invention, tuning circuit 320 comprises an op-amp 321 and resistive elements 322 and 323. The non-inverting input terminal of op-amp 321 is coupled to receive reference voltage Vref, while resistive element 322 is coupled between the output terminal and the inverting input terminal of op-amp 321. Resistive element 323 is coupled between the inverting input terminal of op-amp 321 and ground. Ideally, R322 and R323 should be made large in order to minimize power dissipation in tuning circuit 320. Because resistive elements 322 and 323 are arranged in a voltage divider configuration in the negative feedback loop of op-amp 321, they can be sized to control the magnitude of supply reference voltage V'ccint at the output terminal of op-amp 321. Supply reference voltage V'ccint is given by the equation:

$$V'ccint=Vref(1+R322/R323) \quad [20]$$

where R322 and R323 are the resistances of resistive elements 322 and 323, respectively. Therefore, as long as reference voltage generator 310 provides a reference voltage Vref that is stable at a known voltage, resistive elements 322 and 323 can be used to define a supply reference voltage V'ccint that is equal in magnitude to the desired internal supply voltage Vccint.

The embodiment of output driver circuit 330 shown in FIG. 3 includes an op-amp 331, a resistive element 332, a capacitive element 333, and PMOS power transistors 2210(1) and 2210(2). The non-inverting input terminal of op-amp 331 is coupled to receive supply reference voltage V'ccint, while the inverting input terminal of op-amp 331 is coupled to the source terminals of PMOS power transistors 2210(1) and 2210(2). The gate terminals of PMOS power transistors 2210(1) and 2210(2) are coupled to the output terminal of op-amp 331, while the drain terminals of PMOS transistors 2210(1) and 2210(2) are coupled to receive external supply voltage Vccext. Finally, resistive element 332 and capacitive element 333 are connected in parallel between the inverting input terminal of op-amp 331 and ground.

Supply reference voltage V'ccint from tuning circuit 320 at the non-inverting input terminal of op-amp 331 forces op-amp 331 to provide a gate voltage to PMOS transistors 2210(1) and 2210(2) that causes an internal supply voltage Vccint to be provided at the inverting input terminal of op-amp 331. Resistor 332 provides a path to ground for the currents generated by PMOS power transistors 2210(1) and 2210(2) and is preferably large in order to minimize power dissipation in output driver circuit 330. Op-amp 331 ensures that the magnitude of internal supply voltage Vccint remains equal to the magnitude of supply reference voltage V'ccint, while PMOS transistors 2210(1) and 2210(2) provide increased current sourcing capability for internal supply voltage Vccint. Although the embodiment of output driver circuit 330 shown in FIG. 3 includes only two PMOS power transistors, additional PMOS power transistors are easily added. Typically, output driver circuit 330 would include a PMOS power transistor for each I/O power pin or each circuit power pin in an IC. Capacitor 333 is included to improve transient response and provide additional output stability, and is sized based on the expected load to be driven by output driver circuit 330. While a single capacitor 333 is depicted in FIG. 3 for clarity, the total capacitance indicated by capacitor 333 would typically be provided by individual capacitors at each PMOS power transistor.

Figure 5A:
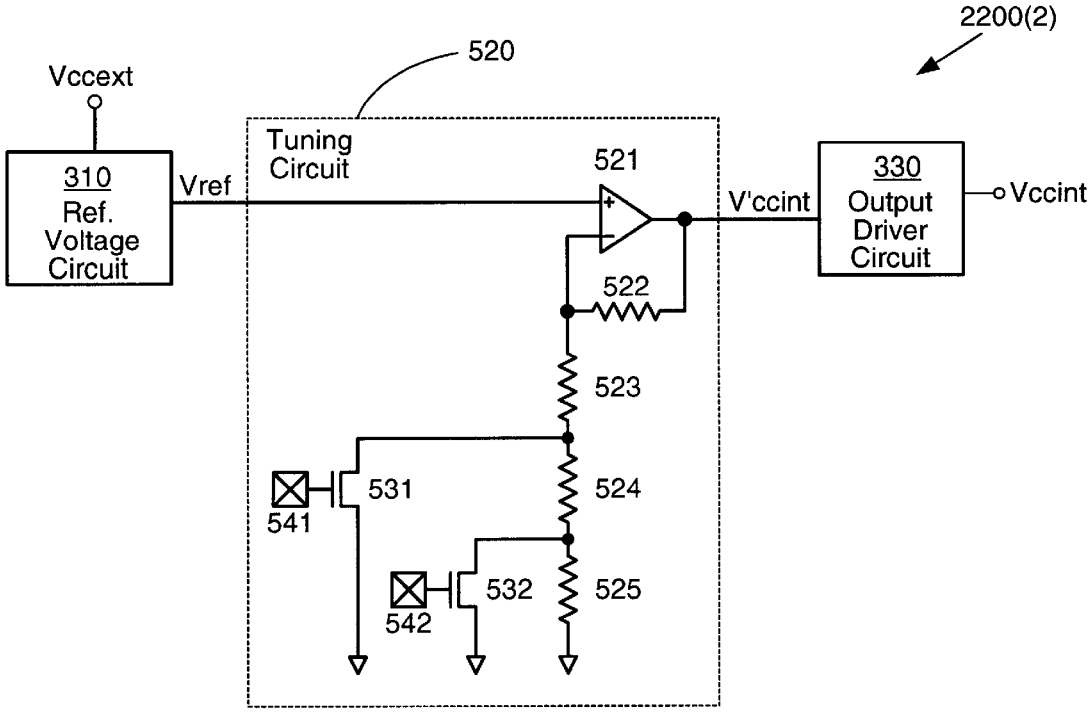
FIGS. 5*a* and 5*b* are circuit diagrams of an embodiment of an adjustable voltage regulator in accordance with the present invention.

FIG. 5*a* shows a schematic circuit diagram of an adjustable voltage regulator circuit 2200(2) in accordance with a second embodiment of the present invention. The structure and operation of adjustable voltage regulator circuit 2200(2) are similar to those of voltage regulator circuit 2200(1) (discussed above). Therefore, the following discussion is specifically directed towards the differences between these two circuits.

Adjustable voltage regulator circuit 2200(2) differs from voltage regulator circuit 2200(1) in the use of a variable tuning circuit 520 rather than tuning circuit 320, which includes no adjustment capability. Variable tuning circuit 520 comprises an op-amp 521, a resistor 522 coupled between the output terminal and inverting input terminal of op-amp 521, and resistors 523–526 serially coupled between the inverting input terminal of op-amp 521 and ground. Variable tuning circuit 520 further includes control circuitry comprising memory cells 541 and 542 and NMOS transistors 531 and 532. NMOS transistor 531 is coupled between the junction of resistors 523 and 524 and ground, the gate terminal of NMOS transistor 531 being coupled to the output terminal of memory cell 541. NMOS transistor 532 is coupled between the junction of resistors 524 and 525 and ground, the gate terminal of NMOS transistor 532 being coupled to the output terminal of memory cell 542.

Variable tuning circuit 520 enables user-control of internal supply voltage Vccint. By controlling the output states of memory cells 541 and 542, the magnitude of supply reference voltage V'ccint from op-amp 521 can be adjusted, thereby enabling the generation of various output voltages Vccint by output driver circuit 330. For example, if the outputs of both memory cells 541 and 542 are in logic LOW states, NMOS transistors 531 and 532 are turned off, and the supply reference voltage V'ccint provided by op-amp 521 is given by:

$$V'ccint=Vref(1+R522/(R523+R524+R525)) \quad [21]$$

where R522–R525 are the resistances of resistors 522–525, respectively. However, if the output of memory cell 542 is brought to a HIGH state, NMOS transistor 532 is turned on, providing a path to ground that bypasses resistor 525.

In that case, supply reference voltage V'ccint becomes:

$$V'ccint=Vref(1+R522/(R523+R524)) \quad [22]$$

Similarly, if the output of memory cell 541 is HIGH, NMOS transistor 531 is turned on, bypassing both resistors 524 and 525 and causing op-amp 521 to provide an supply reference voltage V'ccint given by:

$$V'ccint=Vref(1+R522/R523) \quad [23]$$

In this manner, supply reference voltage V'ccint, and therefore internal supply voltage Vccint, can be adjusted to various levels. By properly sizing resistors 522–525, specific desired internal supply voltages Vccint can be provided by adjustable voltage regulator circuit 2200(2). For example, Table 1 shows the possible output voltages Vccint that can be provided by adjustable voltage regulator circuit 2200(2) when reference voltage Vref equals 1.3 V and resistors 522, 523, 524, and 525 have resistances of 100 kΩ, 65 kΩ, 43 kΩ, and 152 kΩ, respectively.

TABLE 1

Variable Tuning Circuit 520 Sample Settings

| TRANSISTOR STATE | | RESISTOR STATE | | | OUTPUT |
|---|---|---|---|---|---|
| | | 523 | 524 | 525 | |
| 531 | 532 | (65 kΩ) | (43 kΩ) | (152 kΩ) | Vint |
| ON | — | ACTIVE | BYPASS | BYPASS | 3.3 V |
| OFF | ON | ACTIVE | ACTIVE | BYPASS | 2.5 V |
| OFF | OFF | ACTIVE | ACTIVE | ACTIVE | 1.8 V |

Additional resistor segments with the appropriate control circuitry can be added in series with resistors 523–525 to increase the range or resolution of internal voltages that can be generated by variable tuning circuit 520. In addition, a similar multiple-resistor series could be used in place of single resistor 522 to provide greater adjustment flexibility.

Figure 5B:
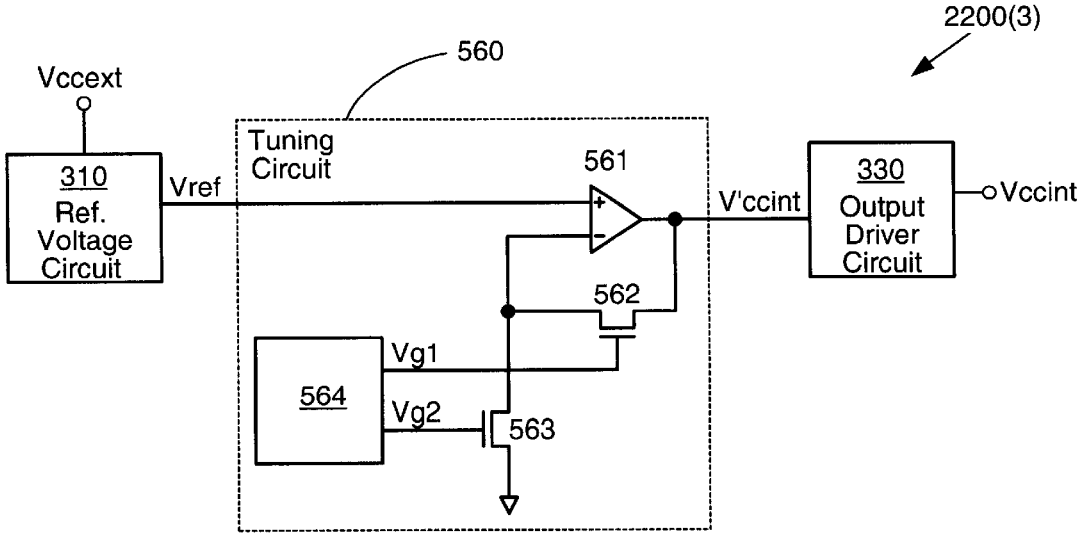

FIG. 5*b* shows a schematic circuit diagram of an adjustable voltage regulator circuit 2200(3) in accordance with another embodiment of the present invention. Adjustable voltage regulator circuit 2200(3) is similar to adjustable voltage regulator circuit 2200(2) shown in FIG. 5*a*, but includes an alternative embodiment of a variable tuning circuit, depicted as a variable tuning circuit 560.

Variable tuning circuit 560 replaces the resistors shown in variable tuning circuit 520 with NMOS transistors 562 and 563. NMOS transistor 562 is coupled in the negative feedback loop of an op-amp 561, while NMOS transistor 563 is coupled between the inverting input terminal of op-amp 561 and ground. A FET control circuit 564 applies gate voltages Vg1 and Vg2 to the gate terminals of NMOS transistors 562 and 563, respectively. Gate voltages Vg1 and Vg2 are sized to make NMOS transistors 562 and 563 operate in the linear region, thereby forming an adjustable voltage divider to define the supply reference voltage V'ccint provided by op-amp 561. By adjusting the values of gate voltages Vg1 and Vg2, FET control circuit 564 can control the voltage output of op-amp 561 as desired by the user. NMOS transistor 562 could alternatively be replaced by a fixed resistor, allowing the full adjustment capability of variable tuning circuit 560 to reside in NMOS transistor 563. Because the effective resistances provided by NMOS transistors 562 and 563 are continuously variable, variable tuning circuit 560 can provide fine adjustment resolution for supply reference voltage V'ccint. However, the serial resistor configuration used in variable tuning circuit 520 shown in FIG. 5*a* would typically provide greater precision for specific target values of supply reference voltage V'ccint.

Although the present invention has been described in connection with several embodiments, it is understood that this invention is not limited to the embodiments disclosed, but is capable of various modifications which would be apparent to one of ordinary skill in the art. Thus, the invention is limited only by the following claims.

What is claimed is:

1. An adjustable voltage regulator for converting an external supply voltage from an external voltage source to a selected internal supply voltage, the adjustable voltage regulator circuit comprising:

a reference voltage generator for converting the external supply voltage to a stable reference voltage; and a variable tuning circuit for adjusting the stable reference voltage to the selected internal supply voltage, wherein the variable tuning circuit comprises:

a first op-amp, a non-inverting input terminal of the first op-amp being coupled to receive the stable reference voltage from the reference voltage generator;

a first resistive element, the first resistive element being connected between an output terminal of the first op-amp and a negative input terminal of the first op-amp, a second resistive element, the second resistive element being connected between the non-inverting input terminal of the first op-amp and a first voltage source; and a control circuit for regulating the resistance of the second resistive element such that an output voltage at the output terminal of the first op-amp is equal to the selected internal supply voltage, wherein the second resistive element comprises a first plurality of serial resistive elements, wherein the control circuit selectively connects the non-inverting input terminal of the first op-amp to the first voltage source through at least one of the first plurality of serial resistive elements, and wherein the control circuit comprises:

a second plurality of MOS transistors, a first signal terminal of each of the second plurality of MOS transistors being connected to a junction of two of the first plurality of serial resistive elements, and a second signal terminal of each of the second plurality of MOS transistors being connected to the first voltage source; and a third plurality of memory cells, an output terminal of each of the third plurality of memory cells being connected to a gate terminal of one of the second plurality of MOS transistors.

2. An adjustable voltage regulator for converting an external supply voltage from an external voltage source to a selected internal supply voltage, the adjustable voltage regulator circuit comprising:

a reference voltage generator for converting the external supply voltage to a stable reference voltage; and a variable tuning circuit for adjusting the stable reference voltage to the selected internal supply voltage, wherein the variable tuning circuit comprises:

a first op-amp, a non-inverting input terminal of the first op-amp being coupled to receive the stable reference voltage from the reference voltage generator;

a first resistive element, the first resistive element being connected between an output terminal of the first op-amp and an inverting input terminal of the first op-amp, a second resistive element, the second resistive element being connected between the inverting input terminal of the first op-amp and a first voltage source; and a control circuit for regulating the resistance of the second resistive element such that an output voltage at the output terminal of the first op-amp is equal to the selected internal supply voltage, wherein the second resistive element comprises a MOS transistor, the gate terminal of the MOS transistor being biased by the control circuit such that the MOS transistor operates in its linear region.

3. The adjustable voltage regulator of claim 2 wherein the control circuit further regulates the resistance of the first resistive element.

* * * * *